US005781080A

United States Patent [19]

Ando

[11] Patent Number: 5,781,080

[45] Date of Patent: Jul. 14, 1998

[54] DIELECTRIC DUPLEXER

[75] Inventor: Masamichi Ando, Nagaokakyo, Japan

[73] Assignee: Murata Manufacturing Co., Ltd., Kyoto, Japan

[21] Appl. No.: 797,337

[22] Filed: Feb. 10, 1997

Related U.S. Application Data

[63] Continuation of Ser. No. 321,518, Oct. 12, 1994, abandoned.

[30] Foreign Application Priority Data

Oct. 15, 1993 [JP] Japan ..... 5-282062

[51] Int. Cl.[6] ..... H01P 5/12; H01P 1/213; H01P 1/20

[52] U.S. Cl. ..... 333/126; 333/134; 333/202

[58] Field of Search ..... 333/126, 129, 333/134, 202, 202 DR, 206, 219.1; 370/38, 123

[56] References Cited

U.S. PATENT DOCUMENTS

| | | | |
|---|---|---|---|
| 4,839,773 | 6/1989 | Ishikawa et al. | 333/202 X |
| 5,229,729 | 7/1993 | Nishikawa et al. | 333/126 |
| 5,428,325 | 6/1995 | Jachowski et al. | 333/134 X |

FOREIGN PATENT DOCUMENTS

| | | | |
|---|---|---|---|
| 0064799 | 11/1982 | European Pat. Off. | 333/202 |
| 278402 | 11/1988 | Japan | 333/202 DR |
| 313901 | 12/1988 | Japan | 333/202 DR |
| 212901 | 8/1989 | Japan | 333/202 DR |
| 260701 | 10/1990 | Japan | 333/134 |
| 6097761 | 4/1994 | Japan | 333/134 |

*Primary Examiner*—Seungsook Ham

*Attorney, Agent, or Firm*—Armstrong, Westerman, Hattori, McLeland & Naughton

[57] ABSTRACT

Dielectric resonators 2*a*, 2*b* and 2*c* which compose a transmitting filter are stored in a conductive casing in one line. Dielectric resonators 3*a*, 3*b* and 3*c* which compose a receiving filter are stored in the conductive casing in one line. Earth electrodes of the neighboring dielectric resonators 2*a* and 3*a*, 2*b* and 3*b*, 2*c* and 3*c* are connected in earth by conductive members 11 such as metal foils.

7 Claims, 5 Drawing Sheets

DIELECTRIC DUPLEXER

This application is a continuation of application Ser. No. 08/321,518 filed Oct. 12, 1994, now abandoned.

BACKGROUND OF THE INVENTION

1. Field of the Invention

The present invention relates to a dielectric duplexer, particularly, to a dielectric duplexer used both as a transmitting and receiving device which has a transmitting filter and a receiving filter in one unitary body.

2. Description of the Prior Art

In cellular base stations of a moving communications system, a dielectric duplexer is used as a transmitting and receiving device. In the dielectric duplexer, the signal passing band of the transmitting dielectric resonator (i.e., the transmitting passing band) and the signal passing band of the receiving dielectric resonator (i.e., the receiving passing band) are different from each other. In the transmitting dielectric resonator, a signal having a frequency of the transmitting passing band passes through the resonator, and a signal having a frequency of the receiving passing band is cut off. Conversely, in the receiving dielectric resonator, a signal having a frequency of the receiving passing band passes through the resonator, and a signal having a frequency of transmitting passing band is cut off.

In the case where the transmitting dielectric resonator and the receiving dielectric resonator are only stored in a conductive casing, it is impossible to have an isolation between the transmitting dielectric resonator and the receiving dielectric resonator. That is, though the transmitting dielectric resonator and the receiving dielectric resonator must have a considerable value of attenuation at the output of each passing band, in the case where both dielectric resonators are only stored in the conductive casing, a leakage of electromagnetic flux is produced between the transmitting dielectric resonator and the receiving dielectric resonator due to the electromagnetic field produced in a space (gap) between the conductive casing and both dielectric resonators. Thus, the attenuation of signals having a transmitting passing band deteriorates in the receiving dielectric resonator, and the attenuation of signals having a receiving passing band deteriorates in the transmitting dielectric resonator.

FIG. 6 is a plan view showing a conventional dielectric duplexer B having a structure for obtaining isolation between the transmitting dielectric resonator 51 and the receiving dielectric resonator 52 which are arranged in parallel, and it shows a state when a cover of a casing is eliminated. The conventional dielectric duplexer has a conductive casing 53 made of die cast aluminum, and a wall 54 is formed at a center portion of the casing 53 to form chambers 55 and 56 for transmitting and receiving at both sides of the wall 54. Transmitting dielectric resonators 51 and receiving dielectric resonators 52 are stored in the chambers 55 and 56. The transmitting dielectric resonators 51 and the receiving dielectric resonators 52 are isolated electrically and magnetically by the wall 54.

In the dielectric duplexer having a structure such as that described above, since the wall 54 must be formed in the conductive casing 53 (which is made of die cast aluminum), the structure of the conductive casing 53 is complex, and resulting disadvantages include high cost and a heavy weight of the conductive casing 53. Further, since the chambers 55, 56 for storing the dielectric resonators 51, 52 are divided with the wall 54, it is difficult to store the dielectric resonators 51, 52, and assembly is not easily facilitated.

Although not shown in FIG. 6, as a dielectric duplexer having high isolation between the transmitting dielectric resonator and the receiving dielectric resonator, there is a dielectric duplexer which has transmitting dielectric resonators and receiving dielectric resonators which are each stored in a conductive casing, and which has transmitting dielectric resonators and receiving dielectric resonators which are stored in a large conductive casing. Further, a dielectric duplexer is provided in which the conductive casings including transmitting dielectric resonators or receiving dielectric resonators which are united by some mechanical structure, and in which both dielectric resonators are connected electrically with each other.

However, since such a dielectric duplexer has a double casing structure, its weight becomes heavy and its size becomes large, resulting in the disadvantages of high cost and difficulty of assembly.

SUMMARY OF THE INVENTION

It is, therefore, the primary object of the invention to provide a dielectric duplexer having high isolation between a transmitting dielectric resonator and a receiving dielectric resonator, and having excellent attenuation characteristics.

The present invention is directed to a dielectric duplexer comprising a first dielectric resonator for passing through a signal having a first frequency band, a second dielectric resonator for passing through a signal having a second frequency band, a conductive casing for storing the first dielectric resonator and the second dielectric resonator, and input/output connectors attached to the conductive casing, wherein the first dielectric resonator and the second dielectric resonator are stored in one chamber of the conductive casing, and the first dielectric resonator and the second dielectric resonator are connected to ground by a conductor.

Since the first dielectric resonator and the second dielectric resonator which are stored in the conductive casing are connected to ground by the conductor, a ground electrode of the first dielectric resonator and a ground electrode of the second dielectric resonator can be held to the same electric potential (ground potential), and potential gradient between the first dielectric resonator and the second dielectric resonator can be eliminated. Thus, electromagnetic coupling between the first dielectric resonator and the second dielectric resonator can be eliminated, and isolation between the first dielectric resonator and the second dielectric resonator can be increased. Therefore, the first dielectric resonator can have a large attenuation at a passing band frequency of the second dielectric resonator, and the second dielectric resonator can have a large attenuation at a passing band frequency of the first dielectric resonator.

Since the isolation can be obtained by a simple method, wherein the first dielectric resonator and the second dielectric resonator are connected by a metal foil, a metal thin plate or the like, a simple structure of the dielectric duplexer can be obtained as compared with a duplexer having a conductive casing divided by a wall, or a duplexer having a double casing structure.

The above and further objects, features, aspects and advantages of the present invention will be more fully apparent from the following detailed description taken together with the accompanying drawings.

DESCRIPTION OF THE PREFERRED EMBODIMENTS

Figure 1A:
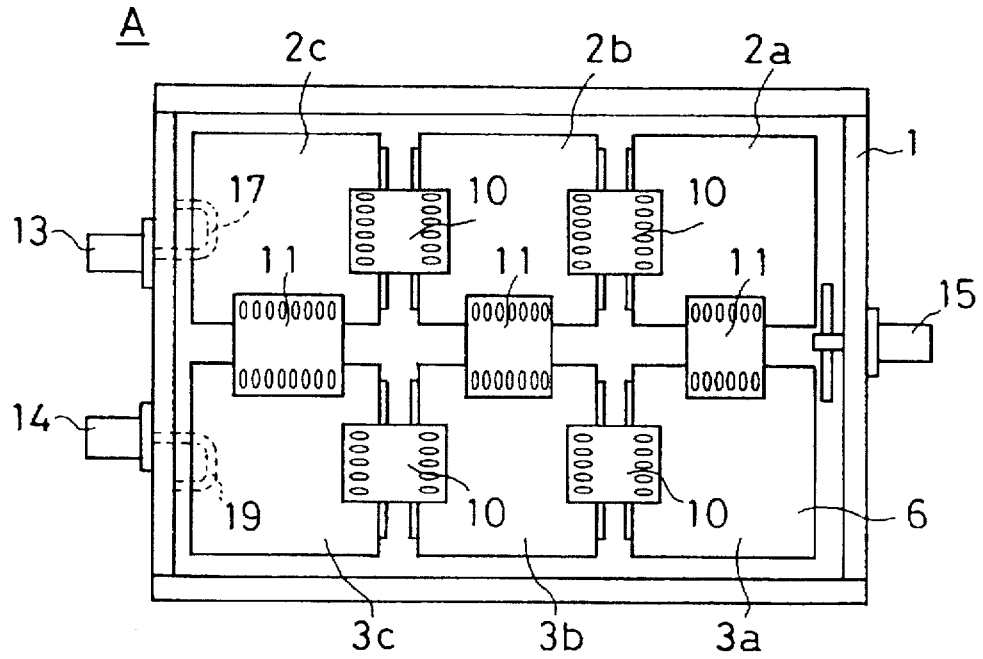
FIG. 1(A) is a plan view showing a dielectric duplexes when a cover of the casing is eliminated.
Figure 1B:
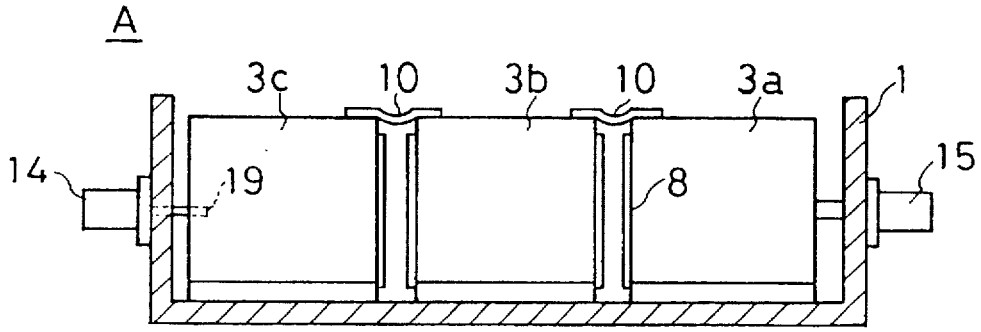
FIG. 1(B) is a sectional view of FIG. 1(A)
Figure 1C:
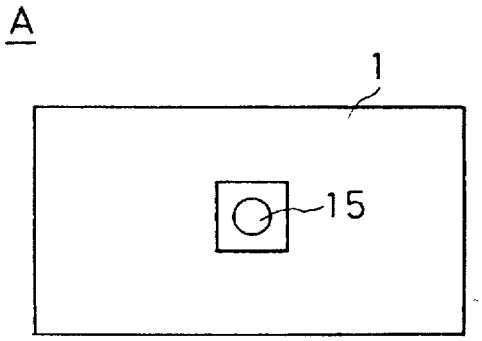
FIG. 1(C) is a front view of FIG. 1(A).

FIG. 1(A), FIG. 1(B) and FIG. 1(C) are respectively a plan view, a sectional view and a front view showing a dielectric duplexer A as an example of the present invention. FIGS. 1(A), 1(B), and 1(C) show a casing in which the necessity for a cover of a casing is eliminated. A conductive casing comprises a casing body 1 and a cover (not shown), and the conductive casing is made of, for example, stainless steel, and has a light weight. In the casing body 1, six dielectric resonator units 2*a*, 2*b*, 2*c*; and 3*a*, 3*b* and 3*c* are arranged in dual lines, as best seen in FIG. 1(A). The dielectric resonator units 2*a*, 2*b*, 2*c*, 3*a*, 3*b* and 3*c* have $TM_{110}$ single mode resonators or $TM_{110}$ dual mode resonators. Three dielectric resonator units 2*a*, 2*b* and 2*c*; and arranged in one line compose a band-pass filter of the receiving side (i.e., constitute a receiving filter), and three dielectric resonator units 3*a*, 3*b* and 3*c* arranged in another line constitute a band-pass filter of the transmitting side (i.e., constitute a transmitting filter).

Figure 2:
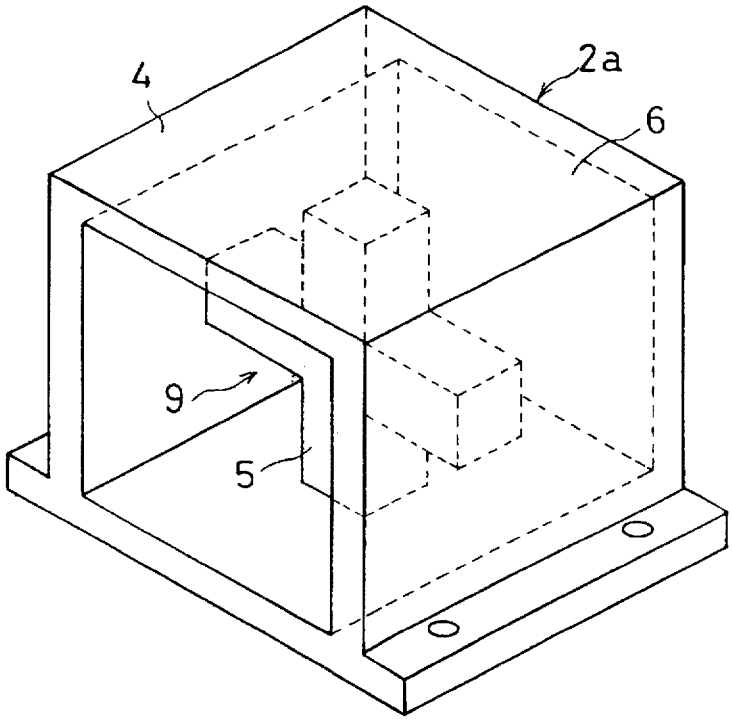
FIG. 2 is a perspective view showing one example of a dielectric resonator unit usable in the dielectric duplexer of FIGS. 1(A)–1(C).
Figure 3:
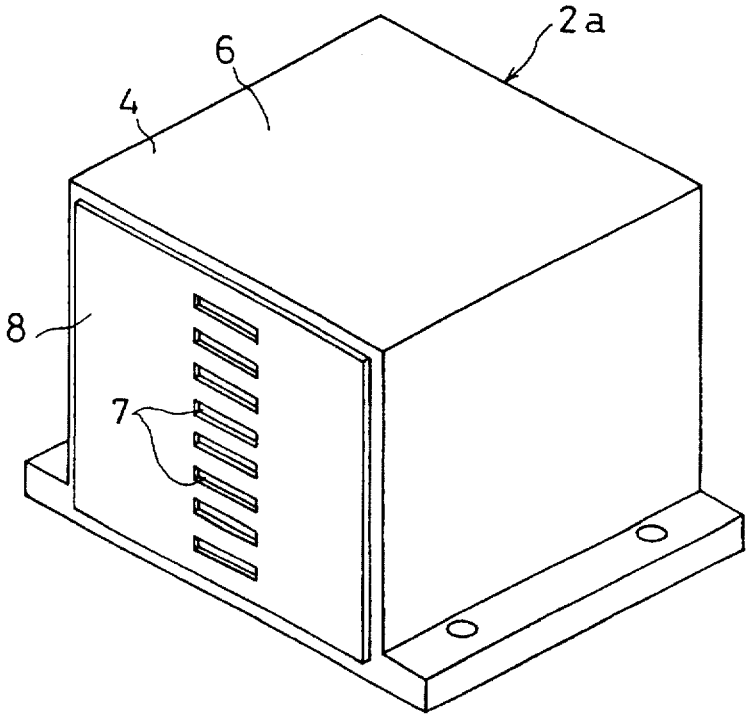
FIG. 3 is a perspective view showing a dielectric resonator unit having a plate.

FIG. 2 is an illustrative view showing a dielectric resonator unit 2*a* as an example of a $TM_{110}$ dual mode dielectric resonator unit. The dielectric resonator unit 2*a* includes a box 4 having a cavity therein. In the cavity of the box 4, a cross-shaped monoblock inner dielectric body 5 is formed. The box 4 is composed, for example, of dielectric ceramics, and a ground electrode 6 is formed by sintering silver on an inner face and an outer face of the box 4. When a coupling is obtained between the dielectric resonator units 2*a*, 2*b* and 2*c*, or between the dielectric resonator units 3*a*, 3*b* and 3*c* which are respectively arranged along a line in the casing body 1 [see FIG. 1(A)], a plate 8 having slits 7 is formed at an opening 9 (see FIG. 2) of the box 4 as shown in FIG. 3, so that the dielectric resonator units are not coupled by useless magnetic flux. In the case of a dual mode dielectric resonator unit, a coupling between resonators in the unit is obtained by forming a notch (not shown) in the cross-shaped inner dielectric body 5.

As best seen in FIG. 1(A), the dielectric resonator units 2*a*, 2*b* and 2*c*, arranged along a line, are connected by conductive members 10, such as metal foils or metal nets, which are soldered to the ground electrodes 6 on outer faces of the boxes 4. Similarly, the dielectric resonator units 3*a*, 3*b* and 3*c*, arranged along a line, are connected by conductive members 10, such as metal foils or metal nets, which are soldered to the ground electrodes 6 on outer faces of the boxes 4. The receiving dielectric resonator units 2*a*, 2*b*, 2*c* and the transmitting dielectric resonator units 3*a*, 3*b*, 3*c*, each arranged in parallel, are connected directly to ground between neighbor units by conductive members 11 such as metal foils or metal nets. Each of the conductive members 10, 11 has slits, cutouts or long holes, or is formed in a net shape, and is soldered solidly to the ground electrodes 6.

Figure 4:
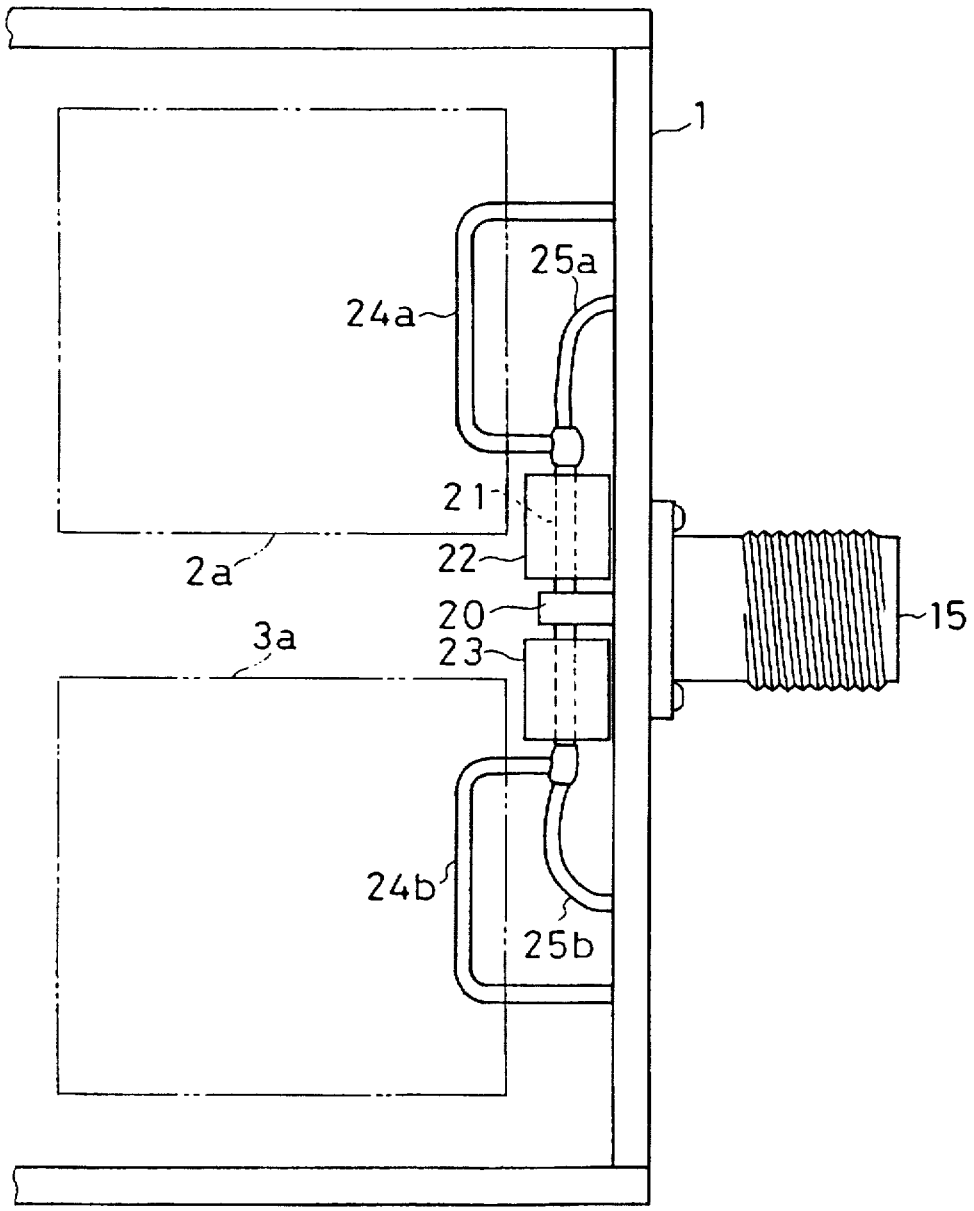
FIG. 4 is a partial plan view showing a structure of a connector portion.

As best seen in FIG. 1(A), connectors 13, 14 and 15 are formed at front and rear sides of the casing body 1. A coupling loop 17 for magnetic coupling with the dielectric resonator unit 2*c* is formed between a central conductor of the connector 13 and ground (i.e., the conductive casing). A coupling loop 19 for magnetic coupling with the dielectric resonator unit 3*c* is formed between a central conductor of the connector 14 and ground (i.e., the conductive casing). FIG. 4 is a partial plan view showing a structure around the connector 15, in which the numeral 20 indicates a central conductor of the connector 15, and the numeral 21 indicates a pin attached to the connector 20. In FIG. 4, the casing body 1 is also shown. Cylindrical bushings 22 and 23 made of fluorocarbon polymers are attached to the pin 21. A coupling loop 24*a* and a small loop 25*a* for phase adjustment are formed between one end of the pin 21 and a ground (i.e., the conductive casing). A coupling loop 24*b* and a small loop 25*b* for phase adjustment are formed between the other end of the pin 21 and a ground (i.e., the conductive casing). The coupling loops 24*a* and 24*b* are respectively coupled magnetically with the resonators of the dielectric resonator units 2*a* and 3*a*. The small loops 25*a* and 25*b* for phase adjustment are used for adjusting phase between the resonators of the dielectric resonator units 2*a*, 3*a* and the central conductor 20 of the connector 15.

It is noted that, since FIG. 1(B) is a sectional view of FIG. 1(A), corresponding numerals have the same name as in FIG. 1(A), and a separate description is therefore not provided.

FIG. 1(C) is a front view of the casing body 1 and the connector 15. These elements having been described hereinabove with respect to FIG. 1(A), no further discussion is being provided of this figure.

By connecting the receiving dielectric resonator units 2*a*, 2*b*, 2*c* and the transmitting resonator units 3*a*, 3*b*, 3*c* to ground by the conductive members 11, the resonators of the transmitting filter and the resonators of the receiving filter can be kept at the same potential (ground potential). Thus, a potential gradient between the transmitting filter and the receiving filter can be eliminated in the conductive casing, leakage of electromagnetic flux between both these filters can be prevented, and high isolation between these filters can be obtained. Therefore, the transmitting filter can have a high attenuation at the frequency of the receiving pass band, and the receiving filter can have a high attenuation at the frequency of the transmitting pass band, resulting in good attenuation characteristics of the dielectric duplexer A.

Figure 5:
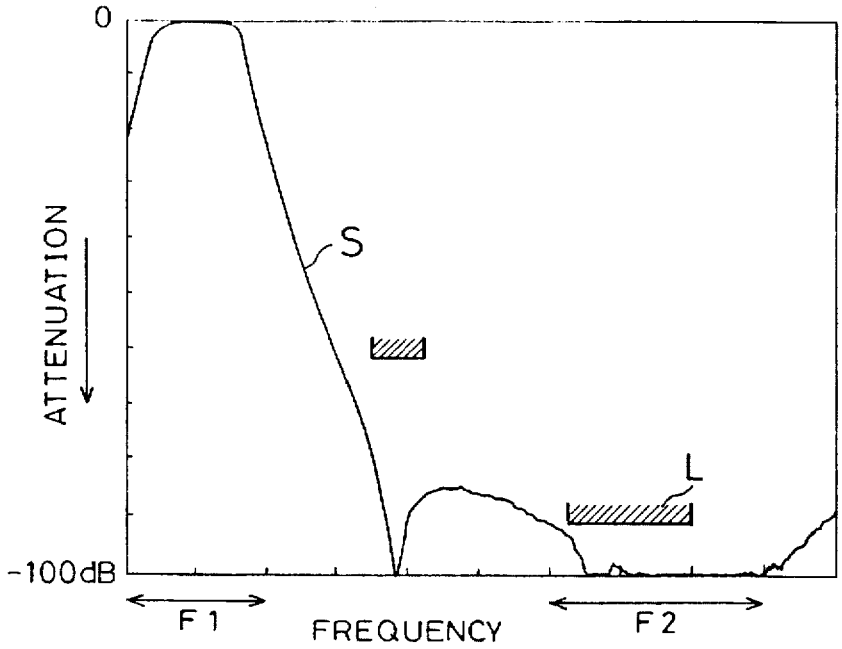
FIG. 5(A) is a graph showing attenuation characteristics of the dielectric duplexer of the present invention.
FIG. 5(B) is a graph showing attenuation characteristics of a conventional dielectric duplexer.
Figure 5:
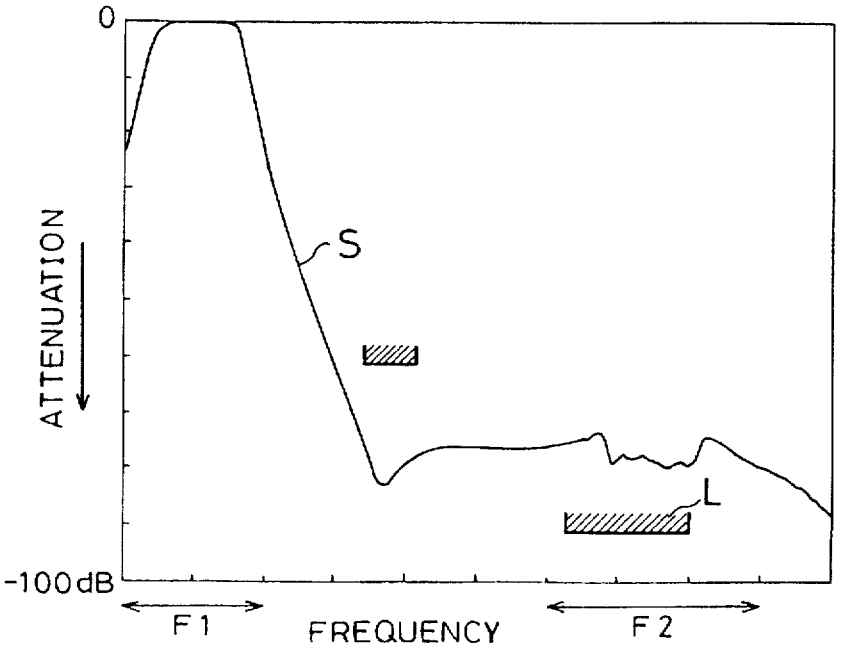
Figure 6:
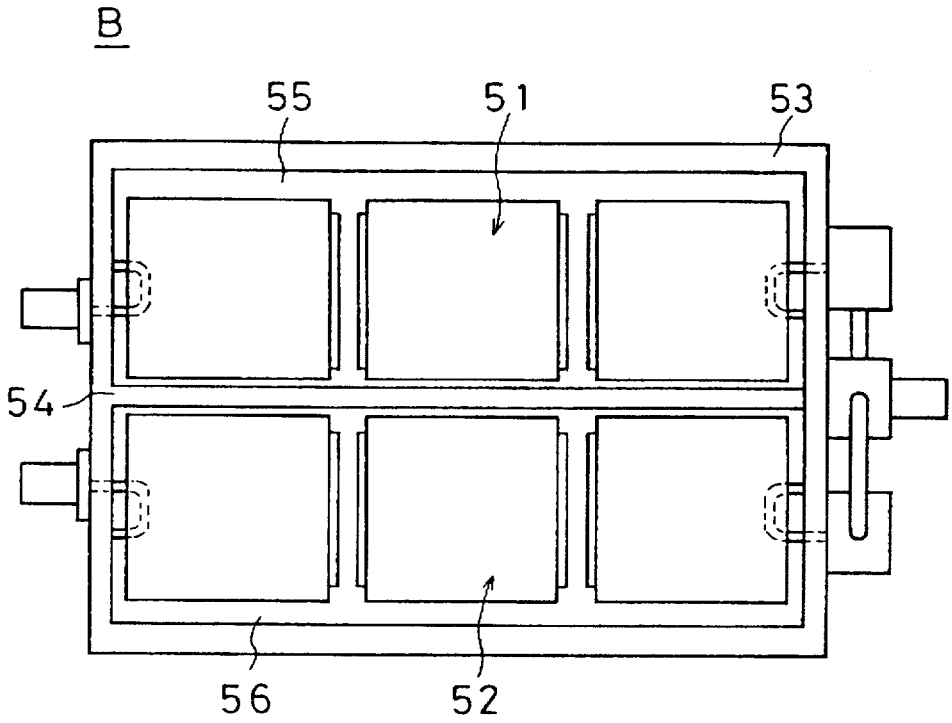
F I G. 6 PRIOR ART
FIG. 6 is a plan view showing a conventional dielectric duplexer when a cover of the casing is eliminated.

FIG. 5(A) and FIG. 5(B) are graphs showing an attenuation characteristics (i.e., experimental values) S of one of receiving filter or transmitting filter in the dielectric duplexer. FIG. 5(A) shows a characteristic of the dielectric duplexer A of the present invention, and FIG. 5(B) shows a characteristic of the conventional dielectric duplexer which has no connection between the transmitting side and the receiving side by any conductive members.

In the FIGS. 5(A), 5(B), F1 shows a pass band of one of the receiving filter or the transmitting filter, and F2 shows a pass band of the other filter. In the case of a conventional dielectric duplexer shown in FIG. 5(B), the attenuation S is over a user's specific line L at the pass band F2 of the other filter. However, in the case of the dielectric duplexer of the present invention shown in FIG. 5(A), the attenuation S is under the user's specific line L.

In the embodiment shown in FIGS. 1 and 4, although all of the dielectric resonator units 2*a*, 2*b*, 2*c* and the dielectric resonators 3*a*, 3*b*, 3*c* are connected to ground between their neighbors by the conductive members 11, only a portion of the dielectric resonator units may be connected. In this case, the connection at a farther portion from the connector 15 (between the dielectric resonator units 2*c* and 3*c*) is preferable in its isolation effect as compared with the connection at a nearer portion to the connector 15 (between the dielectric resonator units 2*a* and 3*a*). It is considered that although the transmitting side and the receiving side are the same potential at the side of connector 15 due to being connected directly by the connector 15, a relatively great effect can be obtained by forming a connection at the side of the connectors 13 and 14 because the connectors 13 and 14 are not connected directly. Although the dielectric resonator units of the transmitting side and the receiving side are connected between neighbors individually by the conductive members 11, plural dielectric resonator units may be connected to ground successively.

According to the present invention, leakage of electromagnetic flux between the first dielectric resonator and the second dielectric resonator can be prevented, and isolation between the first dielectric resonator and the second dielectric resonator can be increased. Therefore, the first dielectric resonator can have a large attenuation at a passing band frequency of the second dielectric resonator, and the second dielectric resonator can have a large attenuation at a passing band frequency of the first dielectric resonator, resulting in excellent attenuation characteristics of the dielectric duplexer.

The isolation can be obtained by a simple method, such that the first dielectric resonator and the second dielectric resonator are connected by a metal foil, metal thin plate, or the like, and a simple structure of the dielectric duplexer can be obtained as compared with a duplexer having a conductive casing divided by a wall, or a duplexer having a double casing structure. Further, the dielectric duplexer can be miniaturized and made to be lightweight, and can be obtained at low cost.

While the present invention has been particularly described and shown, it is to be understood that such description is used merely as an illustration and example rather than limitation, and the spirit and scope of the present invention is determined solely by the terms of the appended claims.

What is claimed is:

1. A dielectric duplexer comprising:

a first filter having a first frequency pass band including at least a first dielectric resonator for passing through signals within the first frequency pass band;

a second filter having a second frequency pass band including at least a second dielectric resonator for passing through signals within the second frequency pass band;

said first and said second dielectric resonator each having a respective inner dielectric body and a corresponding conductive box having openings therein for coupling with input/output connectors or with an adjacent resonator to be coupled, and wherein the inner respective dielectric body is disposed in the corresponding conductive box;

a conductive casing for storing said first dielectric resonator and said second dielectric resonator, said conductive casing electrically connected with each of said conductive boxes;

at least one separate conductive member, electrically connecting only said conductive boxes of the first and second dielectric resonators and not being connected to said conductive casing to eliminate electromagnetic coupling between said first and second dielectric resonators; and first, second and third input/output connectors attached to said conductive casing said first input/output connector being in electromagnetic communication with said first filter, said second input/output connector being in electromagnetic communication with said second filter, and said third input/output connector being in electromagnetic communication with said both of said first and second filters; wherein said first dielectric resonator and said second dielectric resonator are stored in a common chamber of said conductive casing, said first dielectric resonator and said second dielectric resonator being arranged adjacently, and said conductive boxes of said first dielectric resonator and said second dielectric resonator are connected to ground.

2. A dielectric duplexer in accordance with claim 1, wherein each inner dielectric body of said first and second dielectric resonators has a cross-shape.

3. A dielectric duplexer in accordance with claim 1, wherein each of said boxes is comprised of respective dielectric ceramics having corresponding electrodes.

4. A dielectric duplexer in accordance with claim 3, wherein a plurality of said first dielectric resonators and a plurality of said second dielectric resonators are stored in said conductive casing, and a respective plate having corresponding slits is attached to each said box in order to obtain a respective coupling between said first dielectric resonators and between said second dielectric resonators.

5. A dielectric duplexer in accordance with claim 1, wherein one of said first and second filters comprises a band-pass filter of receiving side, and the other of said first and second filters comprises a band-pass filter of transmitting side.

6. The dielectric duplexer of claim 1, wherein said first filter includes a plurality of first dielectric resonators for passing through signals within the first frequency band;

said second filter includes a plurality of second dielectric resonators for passing through signals within the second frequency band; and said at least one separate conductive member includes a plurality of separate conductors, each separate conductor electrically connecting one said first dielectric resonators with each immediately neighboring second dielectric resonator within the conductive casing and not being connected to said conductive casing.

7. The dielectric duplexer of claim 1, wherein each of said conductive boxes of said first and second dielectric resonators has a face with an opening and a face without an opening, said conductive boxes of said first and second dielectric resonators are arranged adjacent to each other so that the faces without an opening of each of said conductive boxes of said first and second dielectric resonators oppose each other, and a separate conductive member, of said at least one separate conductive member, connects said conductive boxes of said first and second dielectric resonators above the opposing faces without openings of said conductive boxes of said first and second dielectric resonators.

* * * * *